US005342203A

United States Patent [19]

Perretta et al.

[11] Patent Number: 5,342,203

[45] Date of Patent: Aug. 30, 1994

[54] LOW PROFILE BACKSHELL/WIRING INTEGRATION AND INTERFACE SYSTEM

[75] Inventors: Frederick A. Perretta; Joseph S. Yednasty, both of Huntington, Conn.

[73] Assignee: United Technologies Corporation, Hartford, Conn.

[21] Appl. No.: 67,454

[22] Filed: May 25, 1993

[51] Int. Cl.[5] ..... H01R 9/09

[52] U.S. Cl. ..... 439/76; 439/607; 439/610

[58] Field of Search ..... 439/55, 67, 76, 77, 439/78, 81, 82, 130, 607, 610; 361/395, 398

[56] References Cited

U.S. PATENT DOCUMENTS

| | | | |
|---|---|---|---|
| 3,701,964 | 10/1972 | Cronin . | |
| 4,950,171 | 8/1990 | Muzslay | 439/76 |
| 5,007,843 | 4/1991 | Smolley . | |
| 5,170,008 | 12/1992 | Evans et al. | 439/610 X |
| 5,227,955 | 7/1993 | Le Bris et al. | 361/395 |
| 5,244,417 | 9/1993 | Perretta et al. | 439/610 |
| 5,246,376 | 9/1993 | Schuhl et al. | 439/610 X |

*Primary Examiner*—Khiem Nguyen
*Attorney, Agent, or Firm*—William W. Jones

[57] ABSTRACT

Multiple conductor wire harnesses in aircraft or the like are interconnected by a single low profile compact backshell assembly. The backshell assembly includes a housing which shields the individual conductors in the housing from ambient EMI noise. The housing has one or more wire harness inlet assemblies and a plurality of outlet sockets. One or more semi-flexible circuit boards are disposed in the housing and are operable to interconnect the individual conductor wires in each inlet with pin and socket conductor connections at the respective outlets. The circuit board provides interconductor EMI noise shielding inside of the housing. Splice connections between conductors can be formed as necessary within the circuit board inside of the housing to allow any degree of inlet to outlet conductor signal paths to be formed inside of the housing as are desired.

14 Claims, 5 Drawing Sheets

LOW PROFILE BACKSHELL/WIRING INTEGRATION AND INTERFACE SYSTEM

TECHNICAL FIELD

This invention relates to electrical connector assemblies and more particularly to a low profile compact, light-weight backshell/wiring integration assembly which can interconnect conductor wires in multiple conductor harnesses with each other.

BACKGROUND ART

Multiple conductor wire harnesses in aircraft, for example, are presently interconnected by means of insulated structures called "backshells" and/or "wiring integration units". Present day backshells are bulky and relatively heavy structures which require one-to-one conductor connections between the inlet and outlet portions of the backshell. These backshells also do not provide efficient conductor-to-conductor EMI shielding, inside of the backshell, since the non-shielded conductors extend within the backshell from the inlet to the outlet. Excessive cross-talk or inter-conductor noise can thus occur within the backshells of the prior art, especially with high power transmission lines.

Since the wire harnesses have an outer bundle EMI shield which insulates the entire conductor bundle, and inner individual conductor EMI shields, both of which must be stripped and grounded before the conductor wires enter the backshell, the unshielded wires will necessarily be vulnerable to EMI noise inside of the backshell although they will be shielded by the backshell from ambient surroundings. Conductors which must be protected from noise of any kind thus cannot be interconnected by the prior art back-shells, as they exist at the present time. The prior art backshells are also lengthy, and increase in length the more conductors are fed into them.

DISCLOSURE OF THE INVENTION

This invention relates to an improved conductor bundle harness backshell connector assembly which provides for improved conductor EMI shield grounding so that a minimal unshielded conductor window exists in the assembly. The connector assembly includes a backshell housing, which is electrically grounded to the aircraft, or the like. The outer bundle shield is grounded to the backshell by means of a first conductive ferrule assembly which telescopes under the stripped outer insulation shield and over the inner shielded conductor wires.

The inner individual conductor shields are grounded to the backshell by means of a ground ring which telescopes under the inner conductor shields and under the ferrule assembly. The telescoping ferrule assembly and ground ring enable the shielding to be grounded to the backshell in a minimal spatial envelope. The unshielded insulated conductor wires are separated and fed from the ground ring through one wall of the backshell. Once inside of the backshell, the conductor wires are stripped and connected to semi-flexible circuit boards which are contained in the backshell. The circuit boards are operable to shield the individual wires from EMI noise which emanates from the other conductor wires in the bundle. The unshielded portion of conductor wires between the ground ring and the circuit boards is therefore minimized; and the degree of interconductor wire EMI noise is also minimized. The use of the semi-flexible circuit boards inside of the backshell enables the size and weight of the backshell to be significantly reduced, and greatly increases the versatility of the interface system. The boards in the backshell also allow FM, HF, VHF and LF signal conductors to be connected by the interface system of this invention.

The backshell assembly has a low flattened profile due to the use of the internal circuit boards. The assembly can be used to interconnect one or more shielded conductor wire harnesses to a plurality of pin and socket connector assemblies. The circuit boards allow flat-to-circular bundle connections to be made, and also enable extensive splicing of individual conductor signal paths to be made within the backshell housing inside of the circuit board. Once a particular circuit board connection is tested and confirmed, it can then be mass produced without further troubleshooting, contrary to currently used backshell assemblies. The backshells can also be bench-tested if desired. The use of the circuit boards in the backshell housing also lends itself to robotic assembly techniques, contrary to current aircraft backshell assemblies, which are assembled by hand.

It is therefore an object of this invention to provide an improved backshell interface system for interconnecting conductor wire harnesses in aircraft or the like.

It is an additional object of this invention to provide an interface system of the character described which minimizes interconductor wire EMI interference.

It is a further object of this invention to provide an interface system of the character described which is of minimal size and weight.

It is another object of this invention to provide an interface system of the character described which allows round-to-rectangular harness interconnections.

It is yet another object of this invention to provide an interface system of the character described which facilitates multiple conductor path splices being formed internally of the backshell.

These and other objects and advantages of the invention will become more readily apparent from the following detailed description of the preferred embodiment of the invention when taken in conjunction with the accompanying drawings in which:

BEST MODE FOR CARRYING OUT THE INVENTION

Figure 1:
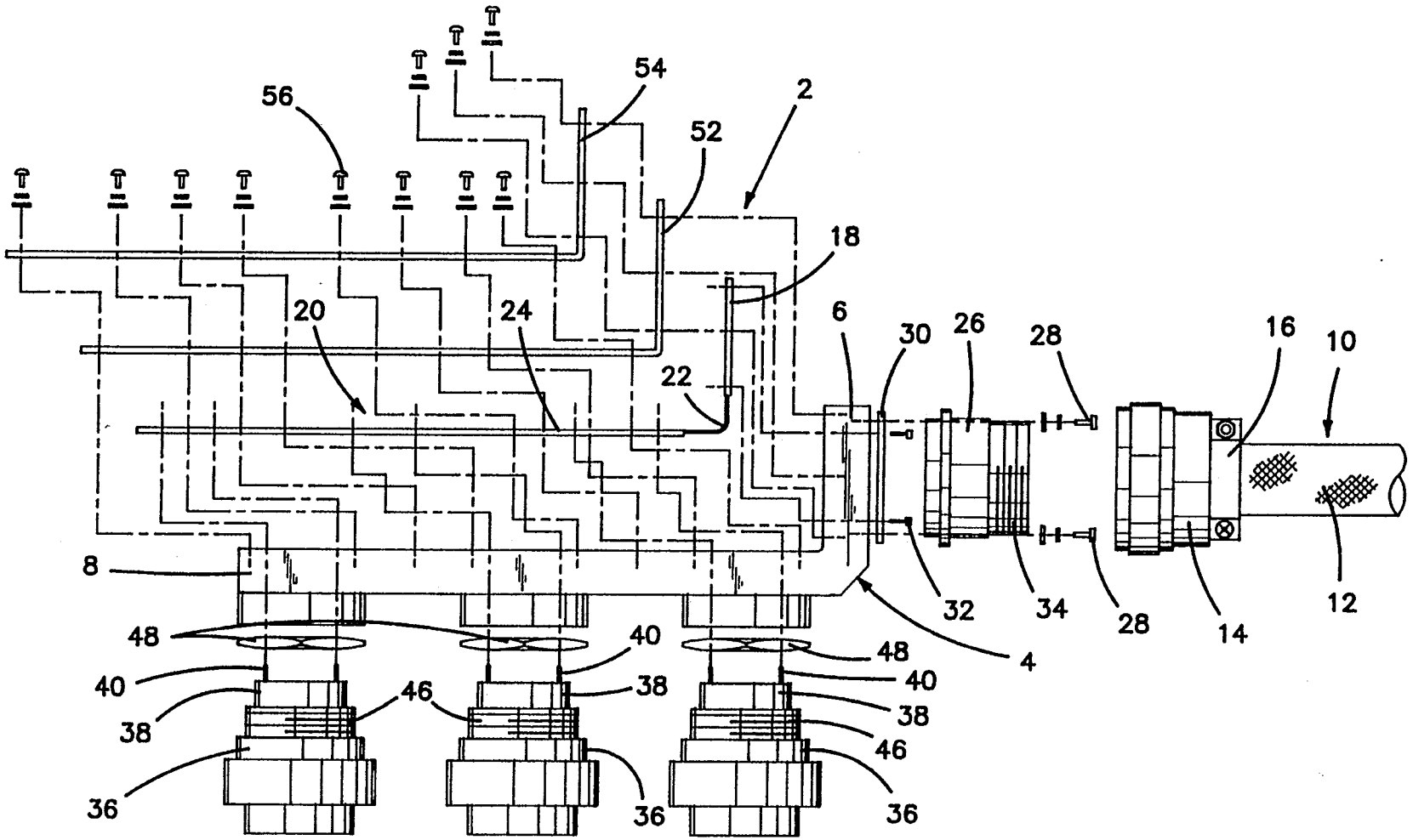
FIG. 1 is an exploded view partly in section of a first embodiment of a right angle single inlet-multiple outlet backshell interface system formed in accordance with this invention.
Figure 3:
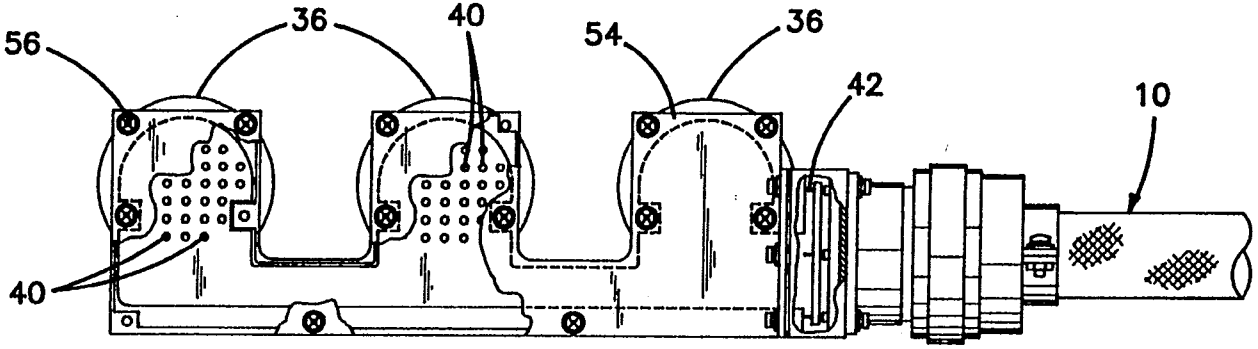
FIG. 3 is a rear elevational view of the backshell assembly partly in section.
Figure 2:
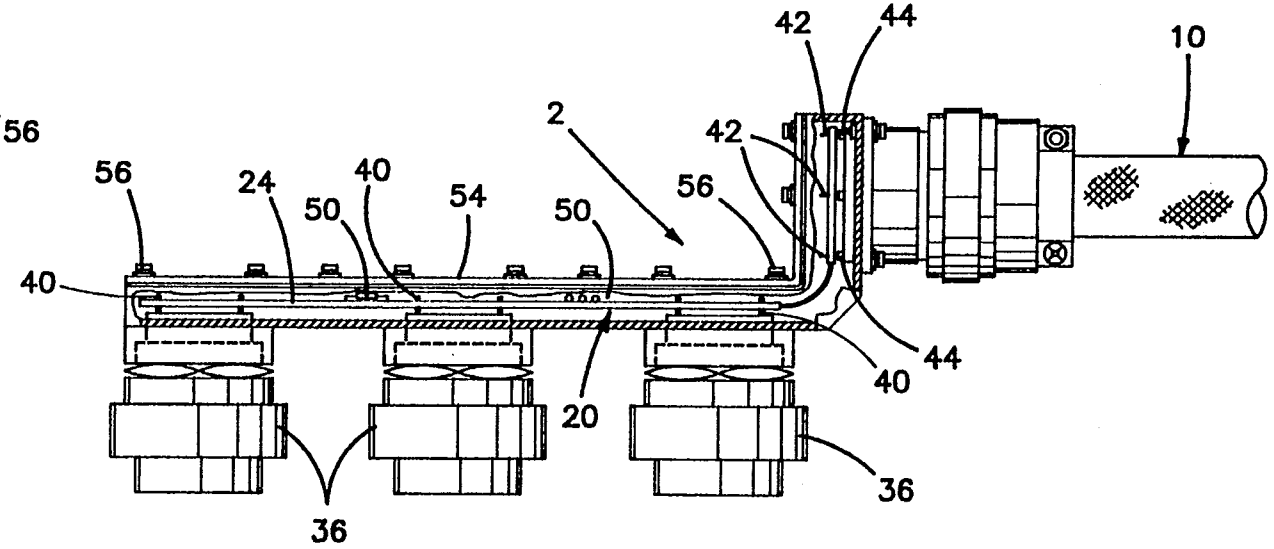
FIG. 2 is a side elevational view of the assembled system of FIG. 1 shown partially in section.
Figure 4:
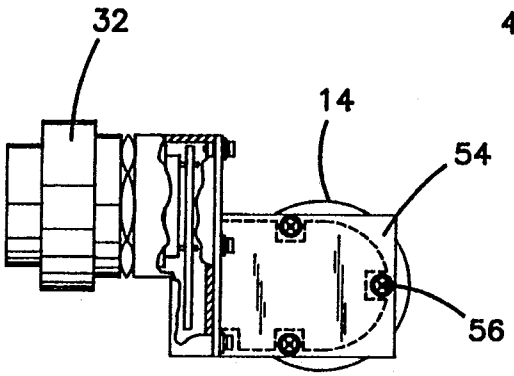
FIG. 4 is an end elevational view, partly in section, of the assembly of FIG. 3 as seen from the left hand side of FIG. 3.

Referring now to the drawings, there is shown in FIGS. 1–4 a first embodiment of a low profile backshell assembly, denoted generally by the numeral 2. The backshell assembly 2 includes an EMI-shielding housing 4 which has a first receptacle portion 6 which is integral with and perpendicular to a second receptacle portion 8. A multi-conductor wire aircraft harness 10 having an outer ambient EMI shield 12 thereon is connected to a first connector housing 14 by means of a strain relief clamp 16. The connector housing 14 is the same general type shown in copending U.S. patent application Ser. No. 07/998,221, filed Dec. 30, 1992 by F. A. Perretta, et al. The connector housing 14 includes an internal grounding assembly which serves to ground the outer shield 12 to the backshell housing 4, and also to ground inner individual conductor shields to the housing 4. The individual conductor wires will be stripped, and each individual conductor wire will be connected to a respective end 18 of a semi-flexible circuit board 20 which is mounted in the housing 4. The circuit board 20 has a first rigid end portion 18, an intermediate flexible portion 22 and a second rigid end portion 24. The first end 18 of the circuit board 20 is mounted inside of the housing part 6, and the second end 24 of the circuit board 20 is mounted in the housing part 8. The individual insulated conductor wires are fed through a bulkhead 26 which extends through an opening in the housing part 6 and is secured thereto by screws 28. An EMI/RFI gasket 30 is secured to the exterior housing part 6 by screws 32 and is sandwiched between the bulkhead 26 and the housing part 6. The bulkhead 26 has a threaded boss 34 onto which the connector housing 14 is screwed.

The second receptacle portion 8 of the housing 4 which contains the second end portion 24 of the circuit board 20, has a plurality of connector housings 36 mounted thereon. The connector housings 36 form pin and socket plugs for the backshell assembly 2. The housings 36 have a diametrically reduced boss 38 which projects through a wall of the receptacle portion 8 and from which project an array of connector pins 40. The connector pins 40 are inserted into mating conductor sockets in the portion 24 of the circuit board 20, which sockets form terminals for the circuit conductor or signal paths. It will be noted in FIG. 2 that the circuit board 20 conducts signals between the pins 40 on the housings 36 and conductors 42 which are the stripped bare metal portions of the individual conductor wires 44 from the harness 10. The conductor housings 36 have threaded bosses 46 which extend into the housing portion 8 and onto which locking jam nuts 48 are threaded. Filter capacitors 50 may be mounted on the board 20 as required.

An EMI/RFI gasket 52 is mounted on the open side of the housing 4 and is sandwiched between a cover 54 and the housing 4. The cover 54 and gasket 52 are held in place by a plurality of screws 56.

Figure 5:
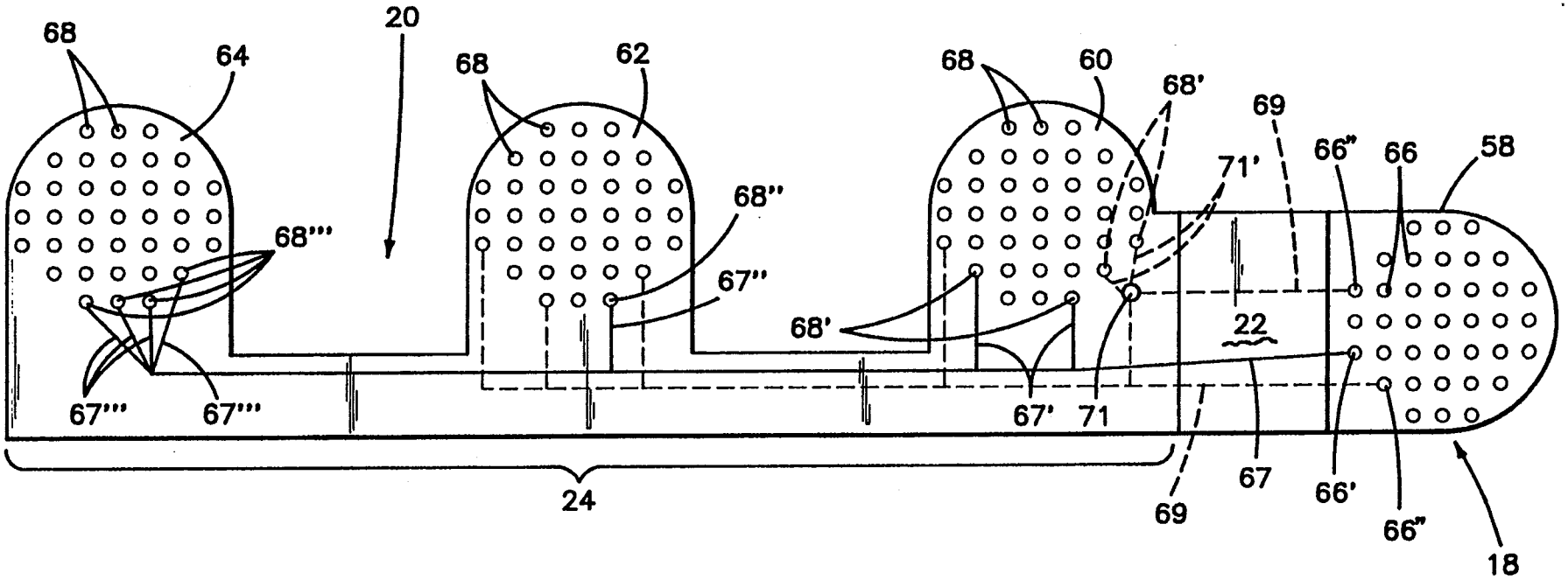
FIG. 5 is a plan view of the circuit board used in conjunction with the backshell assembly of FIGS. 1–4.
Figure 6:
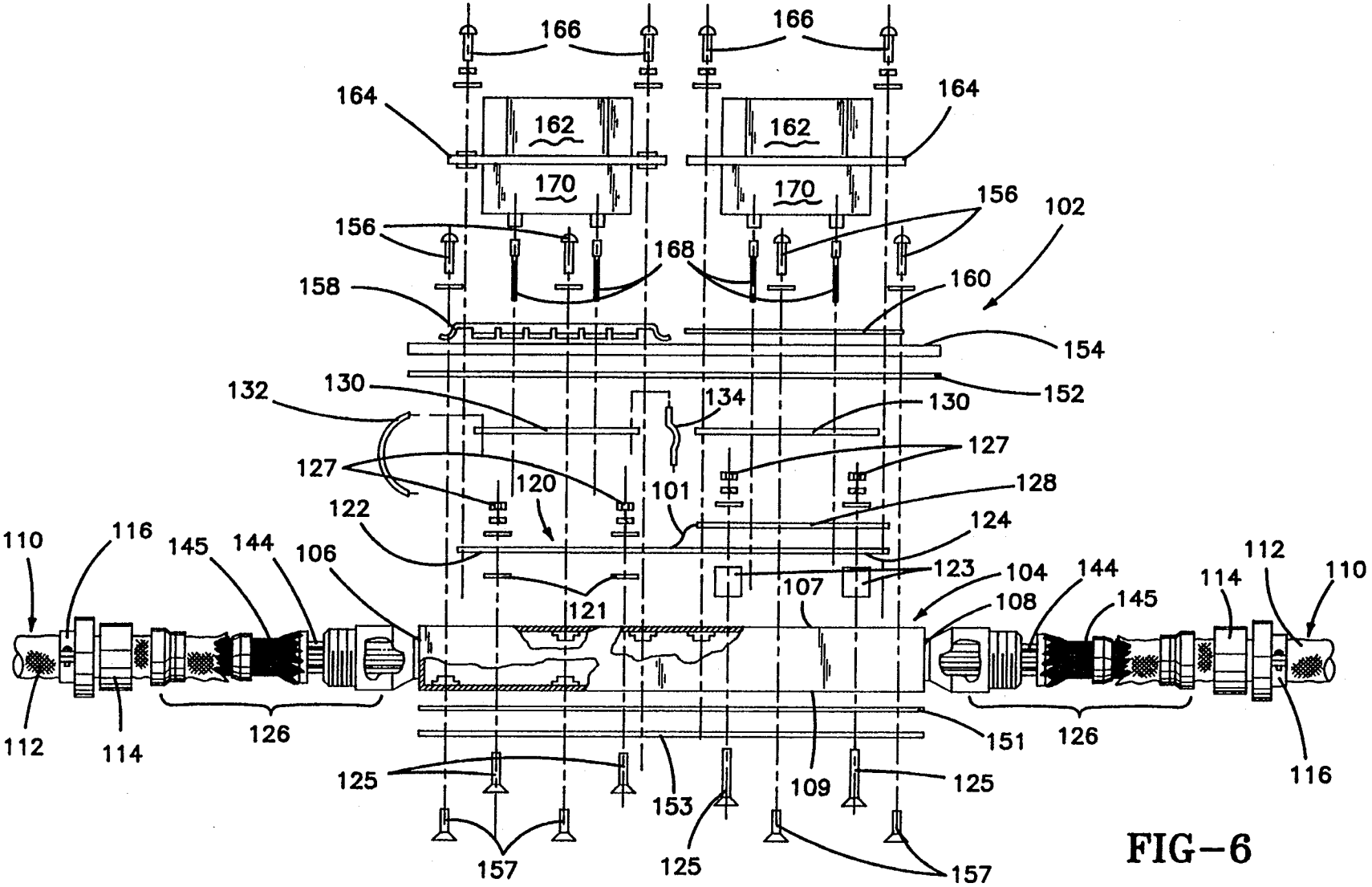
FIG. 6 is an exploded view, partly in section, of another embodiment of a backshell assembly formed in accordance with this invention.
Figure 8:
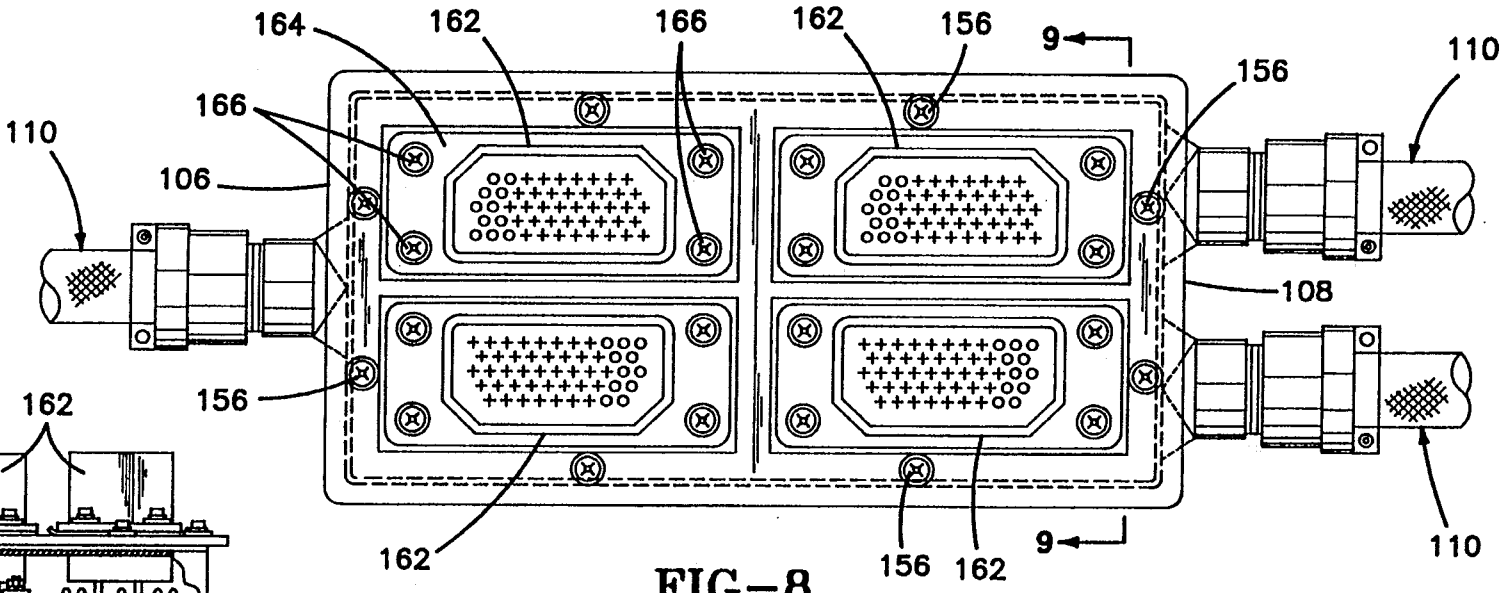
FIG. 8 is a plan view of the backshell.

Referring to FIG. 5, details of the semi-rigid circuit board 20 are shown. The board 20 is formed with four lobes 58, 60, 62, and 64. The lobe 58 is in the rigid end portion 18 of the board 20 and contains an array of sockets 66 which form the board terminals for the individual conductor wires 42 from the harness 10 (see FIG. 3). The lobes 60, 62 and 64 are each provided in an array of sockets 68 which form board terminals for the pins 40 in the connector housings 36 (see FIG. 2). The board 20 includes signal conductor paths which extend from the sockets 66 through the flexible portion 22 of the board 20 to respective ones of the sockets 68. The board 20 shields the individual conductor paths from inter-conductor EMI noise from terminal 66 to terminal 68. The board 20 is a multilayer component which provides the signal paths from terminals 66 to terminals 68 in different planes through the thickness thereof. Signal path splices can be made in a number of different ways in the board 20. For example, a first signal conductor path 67 (shown in solid lines) will be disposed in a predetermined plane within the board 20 and originate at socket 66′. This signal conductor path can be spliced in plane to one or more signal conductor paths 67′ that are also connected to terminal sockets 68′ in lobe 60; and may also be spliced in plane to another signal conductor path 67″ which is connected to a terminal socket 68″ in the lobe 62; and may additionally be spliced in plane to yet another set of signal conductor paths 67‴ which are connected to terminal sockets 68‴ in the third lobe 64. Other signal conductor paths 69 (shown in broken lines) can emanate from other terminal sockets 66″ in the lobe 58 and can be connected to a through plane conductive post 71 which serves to interconnect the signal paths 69 with other signal paths 71′ connected to terminal posts 68′ in the lobe 60. Thus through plane conductor path splices can be formed inside of the backshell assembly. Additional in plane splices are shown in broken lines in FIG. 5 from the conductor path 69 to terminal sockets in the lobes 60 and 62. The opportunities to selectively splice and interconnect terminals 66 with terminals 68 in the compact backshell 4 are essentially unlimited whereby the backshell assembly 2 of this invention will have a geometry which is specific to the section of an aircraft on which it is mounted, and thus it will be "aircraft dedicated" not system dedicated, as with the prior art backshells. Nevertheless any particular multi-component electrical system can operate through the properly designed compact backshell assembly shown herein, and can be installed in any type of craft which has use for such a system. Thus a particular radar or communications or auto pilot system, or any other system, can be installed in any aircraft, any water craft, or any land craft that may have a need for it, and all will include an identically formatted backshell or wiring integration interconnecting assembly.

Referring now to FIGS. 6–9 there is shown another embodiment of a backshell assembly formed in accordance with this invention. The backshell assembly is denoted generally by the numeral 102 and includes an EMI/RFI-shielding housing box 104 having opposite end walls 106 and 108 through which electrically insulated individual conductor wires 144 pass from a plurality of wire harnesses 110. It will be noted from FIG. 8 that a plurality of the wire harnesses 110 can be connected to either of the backshell end walls 106 and 108, in this particular embodiment, there being two harnesses on the end wall 108, and one on the end wall 106. The wire harnesses have an outer EMI/RFI shielding sheath 112, and the inner conductor wires 144 are provided with individual inner EMI/RFI shield sheaths 145. The wire harnesses 110 pass through strain relief clamps 116 and connector housings 114 into an outer and inner shielding ground assembly of the same general type described previously in connection with the first embodiment of the invention, and described in the aforesaid copending application for U.S. patent application Ser. No. 07/998,221. The top and bottom walls 107 and 109 of the housing 104 are open so that the interior components of the assembly 102 may be properly positioned and connected together. The bottom wall 109 of the housing 104 is closed by an EMI shielding gasket 151 and a bottom cover panel 153, which are clamped to the housing 104 by a plurality of screws 157. A first semi-flexible circuit board 120 is mounted on a set of insulating spacers 121. The board 120 has a plurality of rigid portions 122, 124 and 128, and an intermediate flexible portion 101 which connects the portions 122 and 124 to the portion 128. The circuit board portions 124 and 128 are spaced apart from each other by insulating spacers 123. The board 120 and spacers 121 and 123 are secured in place by mounting screws 125 and nuts 127. A plurality of additional circuit boards 130 are disposed in the housing 104, and are selectively connected to the various portions 122, 124 or 128 by means of interface cables 132 and/or wire jumpers 134. The top wall 107 of the housing 104 is closed by an EMI shielding gasket 152 and a top cover 154 which are held in place by screws 156. A conductive interface plate 158 and an outer EMI shielding gasket 160 are mounted on the cover 154.

Figure 7:
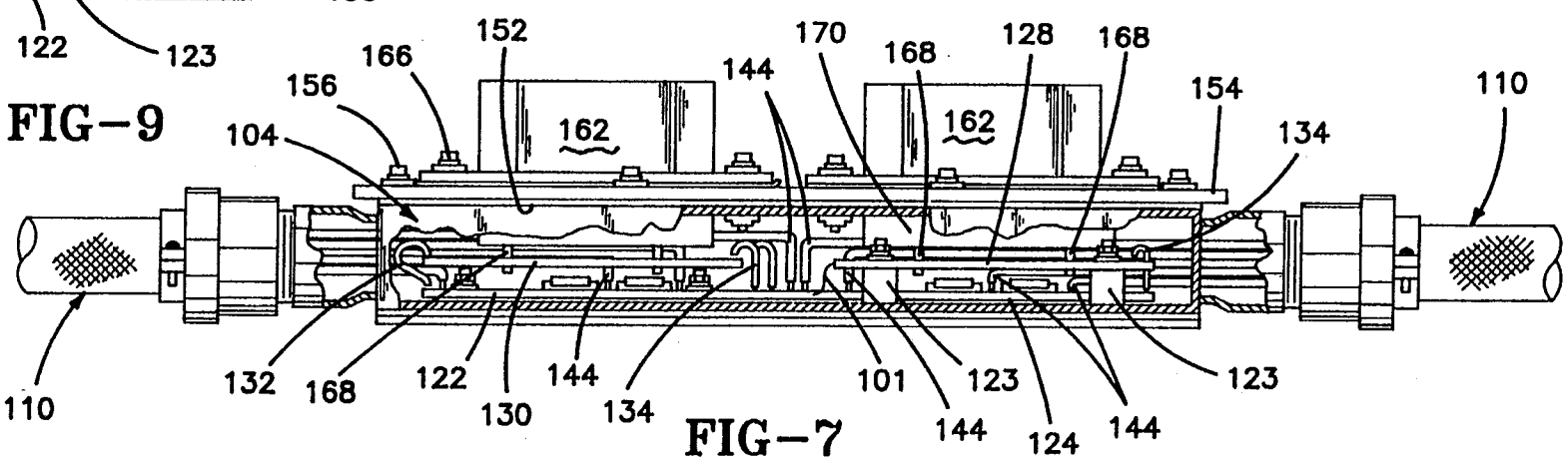
FIG. 7 is a side elevational view of the backshell of FIG. 6 taken partly in section.
Figure 9:
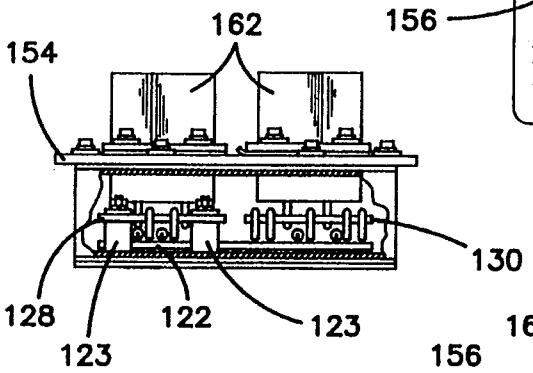
FIG. 9 is a cross-sectional view taken along line 9—9 of FIG. 8.

A plurality of pin and socket conductor connectors 162 are mounted on the top cover 154 by means of mounting flanges 164 through which pass mount screws 166. The connectors 162 contain elongated pins/sockets 168 which are connected to terminal sockets in the circuit boards 130 and/or 128. The pins/sockets 168 project from bosses 170 on the connectors 162, which bosses 170 extend into the interior of the housing 104. FIG. 7 best illustrates the connections of the individual conductor wires 144 to the circuit board portions 122 and 124; the pin/socket 168 connections to the circuit boards 130 and 128; and the interconnecting jumpers 134, interfaces 132, and flexible board portion 101 which provide internal signal path connections between the various circuit boards within the housing 104.

It will be seen that selective interconnections between the boards 122, 124, 128 and 130 can provide a myriad of shielded and reproducible signal paths between the conductor wires 144 with pin/sockets 168, with other conductor wires 144, and between pin/sockets 168. Thus, the wire harnesses 110 can be connected to each other or to any of the connectors 162; and any of the connectors 162 can be connected to any of the other connectors 162.

It will be readily appreciated that the backshell connector assembly of this invention provides a very compact, lightweight juncture for interconnecting electrical systems on aircraft, or other unit. Signal path maps are completely reproducible from assembly to assembly. The assembly can be constructed robotically, can be bench tested, and is aircraft oriented rather than system oriented. New or modified system junctions can be made merely by replacing one backshell assembly with another of identical size and/or configuration, but which has a different signal path scheme embedded in the circuit board or boards contained in the backshell.

Since many changes and variations of the disclosed embodiment of the invention may be made without departing from the inventive concept, it is not intended to limit the invention otherwise than as required by the appended claims.

What is claimed is:

1. An interface system for interconnecting individual conductor wires to multi-conductor bundle harnesses in a grounded environment, said system comprising:

a) an ambient-EMI shielding housing which is grounded to said grounded environment;

b) a multi-conductor bundle harness having an outer EMI shielding; and a plurality of conductor wires shielded from ambient EMI by said outer shielding, and said conductor wires being shielded from inter-conductor EMI by inner individual EMI shields;

c) a conductor housing mounted on said shielding housing, said conductor housing including means forming a plurality of signal-conducting connectors therein;

d) circuit board means mounted in said shielding housing, said circuit board means having a first array of conductive sockets, and a second array of conductive sockets; a plurality of conductive paths in said circuit board means operable to connect each of said conductive sockets in said first array with at least one of said conductive sockets in said second array, each of said conductive paths being shielded from inter-conductor path EMI;

e) means connecting each of said conductive wires with an associated one of said conductive sockets in said first array; and f) means connecting each of said signal-conducting connectors with an associated one of said conductive sockets in said second array.

2. The system of claim 1 wherein said shielding housing has a flattened rectangular configuration when viewed in cross-section.

3. The system of claim 1 wherein there are a plurality of conductor housings on said shielding housing and wherein said second array of conductive sockets in said circuit board means comprises separate groups of conductive sockets associated with each of said conductor housings.

4. The system of claim 3 comprising conductive path splices in said circuit board means operable to interconnect one of said conductive sockets in said first array with more than one of said conductive sockets in said second array.

5. The system of claim 4 wherein said splices are operable to interconnect one of said conductive sockets in said first array with one of said conductive sockets in at least two of said separate groups of conductive sockets.

6. The system of claim 4 wherein said multi-conductor bundle harness is mounted on a first wall of said shielding housing and further comprising a plurality of outgoing conductor housings mounted on a second wall of said shielding housing which is angularly offset from said first wall, and wherein said circuit board means includes a first rigid portion adjacent to said first wall and containing said first array of conductive sockets and a second rigid portion containing said second array of conductive sockets, and wherein said circuit board means also includes a flexible medial portion interconnecting said first and second rigid portions, said flexible medial portion containing portions of said conductive paths.

7. The system of claim 4 wherein said circuit board means comprises a plurality of separate circuit boards mounted in said shielding housing, there being separate conductor housing circuit boards associated with each of said conductor housings, each of which conductor housing circuit boards containing one of said groups of conductive sockets; and a separate conductor bundle harness circuit board containing said first array of conductive sockets; and means electrically connecting said separate conductor housing circuit boards with said bundle harness circuit board.

8. The system of claim 7 comprising a plurality of conductor bundle harnesses connected to opposite end walls of said shielding housing, said conductor bundle harness circuit board extending between said end walls of said shielding housing and comprising conductive socket arrays associated with each of said conductor bundle harnesses, which socket arrays are disposed at opposite ends of said conductor bundle harness circuit board, each of said conductor bundle harnesses being connected to at least one of said conductor housings.

9. The system of claim 8 wherein said conductor bundle harness circuit board includes a first rigid portion containing said conductive socket arrays which are associated with said conductor bundle harnesses; a second rigid portion containing a conductive socket array, and a flexible portion connecting said first rigid portion with said second rigid portion; and conductive means interconnecting said conductive socket array in said second rigid portion with a conductive socket group in one of said conductor housing circuit boards.

10. An interface assembly for use in interconnecting individual conductor wires in one conductor bundle harness with individual conductor wires in another conductor bundle harness, said assembly comprising:

a) an ambient-EMI shielding housing capable of being electrically grounded; and b) circuit board means mounted in said shielding housing, said circuit board means having a first array of conductive sockets and a second array of conductive sockets, and further comprising a plurality of internal conductive paths therein which are operable to connect each of said conductive sockets in said first array with at least one of said conductive sockets in said second array, each of said conductive paths being shielded from inter-conductor path EMI.

11. The interface assembly of claim 10 wherein said shielding housing has a flattened configuration with first and second adjacent side walls which are angularly offset from each other; and wherein said circuit board means includes a first rigid portion adjacent to said first side wall of said shielding housing; a second rigid portion adjacent to said second side wall of said shielding housing; and a flexible medial portion interconnecting said first and second rigid portions, said flexible portion containing portions of said conductive paths.

12. The interface assembly of claim 11 wherein said second array of conductive sockets in said circuit board means comprises separate groups of conductive sockets associated with separate conductor bundle harnesses, and further comprising conductive path splices in said circuit board means operable to interconnect one of said conductive sockets in said first array with more than one of said conductive sockets in at least one of said groups of conductive sockets.

13. An electrical interface assembly for interconnecting plural first conductor wires in a first wire harness with plural second conductor wires in a second wire harness, said assembly comprising:

a) a first pin/socket junction which includes first individual pin/socket electrical signal conductors, with each of said first pin/socket signal conductors being electrically connected to one of said first conductor wires in said first wire harness;

b) a circuit board containing a plurality of electrically conductive paths, with at least one of said conductive paths being electrically connected to one of said first pin/socket conductors;

c) a second pin/socket junction which includes second pin/socket electrical signal conductors, with each of said second pin/socket electrical signal conductors being electrically connected to one of said conductive paths in said circuit board, and also electrically connected to one of said second conductor wires in said second wire harness; and d) means in said circuit board forming at least one splice between a pair of said electrically conductive paths so as to form at least one conductive path that allows electrical signals to be transmitted from one of said conductive wires in one of said wire harness to more than one of said conductive wires in the other of said wire harnesses.

14. The interface assembly of claim 13 further comprising filter capacitors for selectively filtering signals passing through said assembly.

* * * * *

UNITED STATES PATENT AND TRADEMARK OFFICE

CERTIFICATE OF CORRECTION

PATENT NO. : 5,342,203

DATED : August 30, 1994

INVENTOR(S) : Frederick A. Perretta, et al

It is certified that error appears in the above-identified patent and that said Letters Patent is hereby corrected as shown below:

Column 8, line 41, "harness" should read "harnesses"

Signed and Sealed this

Twentieth Day of December, 1994

*Attest:*

Bruce Lehman

BRUCE LEHMAN

*Attesting Officer*

*Commissioner of Patents and Trademarks*